US010954725B2

(12) United States Patent
Crowther et al.

(10) Patent No.: US 10,954,725 B2
(45) Date of Patent: Mar. 23, 2021

(54) MULTIPLE POSITION DRILLING STABILIZER

(71) Applicant: Arrival Oil Tools, Inc., Leduc (CA)

(72) Inventors: Mike Crowther, Carlisle (GB); Laurier E. Comeau, Calgary (CA); Kaidel Martinez, Edmonton (CA); Jayson Russell, Calgary (CA)

(73) Assignee: Arrival Oil Tools, Inc., Leduc (CA)

( * ) Notice: Subject to any disclaimer, the term of this patent is extended or adjusted under 35 U.S.C. 154(b) by 41 days.

(21) Appl. No.: 16/276,046

(22) Filed: Feb. 14, 2019

(65) Prior Publication Data

US 2020/0263507 A1 Aug. 20, 2020

(51) Int. Cl.
*E21B 17/10* (2006.01)
*E21B 7/06* (2006.01)

(52) U.S. Cl.
CPC ..... *E21B 17/1014* (2013.01); *E21B 7/06* (2013.01)

(58) Field of Classification Search
CPC ..... E21B 17/1014; E21B 7/06; E21B 7/068; E21B 23/04; E21B 4/02; E21B 7/062; E21B 17/07; E21B 17/1078; E21B 17/20; E21B 23/006; E21B 44/005; E21B 47/095; E21B 4/04; E21B 4/16
See application file for complete search history.

(56) References Cited

U.S. PATENT DOCUMENTS 4,046,204 A 9/1977 Takaoka et al.
4,143,722 A 3/1979 Driver
4,388,974 A 6/1983 Jones et al.
4,467,879 A * 8/1984 Burge ..... E21B 17/22 175/325.4
4,491,187 A * 1/1985 Russell ..... E21B 10/322 175/325.2
4,848,490 A 7/1989 Anderson
4,854,399 A * 8/1989 Zijsling ..... E21B 17/1078 175/61
5,181,576 A * 1/1993 Askew ..... E21B 17/1014 175/61
5,265,684 A * 11/1993 Rosenhauch ..... E21B 17/1014 175/61
5,293,945 A 3/1994 Rosenhauch et al.
5,318,137 A 6/1994 Johnson et al.
5,318,138 A 6/1994 Dewey et al.
(Continued)

FOREIGN PATENT DOCUMENTS

EP 0994236 A2 4/2000
GB 2336171 A 10/1999
(Continued)

*Primary Examiner* — Daniel P Stephenson
(74) *Attorney, Agent, or Firm* — Schafer IP Law

(57) ABSTRACT

A downhole, hydraulically actuated drilling stabilizer provides versatility in a bottom-hole assembly. The drilling stabilizer can be used in a directional drilling application to help control the inclination in an extended reach or horizontal well. The drilling stabilizer has stabilizer blade members with an angular design portion that provides versatility in a bottom-hole assembly. The stabilizer can also be used in a conventional rotary bottom-hole assembly or positioned below a steerable motor. A drilling stabilizer with adjustable extension diameters provides improved inclination control over currently existing options.

16 Claims, 12 Drawing Sheets

(56) References Cited

U.S. PATENT DOCUMENTS

| | | | | |
|---|---|---|---|---|
| 5,836,406 | A | 11/1998 | Schuh | |
| 5,941,323 | A * | 8/1999 | Warren | E21B 7/062 175/74 |
| 6,158,533 | A * | 12/2000 | Gillis | E21B 47/095 175/325.1 |
| 6,227,312 | B1 * | 5/2001 | Eppink | E21B 7/064 175/57 |
| 6,290,002 | B1 | 9/2001 | Comeau et al. | |
| 6,328,119 | B1 | 12/2001 | Gillis et al. | |
| 7,493,971 | B2 * | 2/2009 | Nevlud | E21B 10/322 175/266 |
| 8,448,722 | B2 | 5/2013 | Konschuh et al. | |
| 2018/0038201 | A1 * | 2/2018 | Evans | E21B 10/322 |
| 2020/0141188 | A1 * | 5/2020 | Marshall | E21B 23/006 |

FOREIGN PATENT DOCUMENTS

| | | | |
|---|---|---|---|
| GB | 2355275 | A | 4/2001 |
| GB | 2480128 | A | 11/2011 |

* cited by examiner

MULTIPLE POSITION DRILLING STABILIZER

TECHNICAL FIELD

The present invention relates to the field of directional drilling and more specifically to a drilling stabilizer suitable for use in downhole drilling operations.

BACKGROUND ART

Directional drilling involves controlling the direction of a wellbore as it is being drilled. It is often necessary to adjust the direction of the wellbore frequently while directional drilling, either to accommodate a planned change in direction or to compensate for unintended and unwanted deflection of the wellbore.

A completed measurement of the inclination and azimuth of a location in a well must be known with reasonable accuracy to ensure a correct wellbore path. These measurements include inclination from vertical, azimuth of the wellbore, and length of the drill string in hole. This set of measurements is commonly called a "Directional Survey" and allows a directional driller to compute the 3D position of the drilling bit and hence the path of the wellbore.

Directional drilling typically utilizes a combination of three basic techniques, each of which presents its own special features. First, the entire drill string may be rotated from the surface, which in turn rotates a drilling bit connected to the end of the drill string. This technique, sometimes called "rotary drilling," is commonly used in non-directional drilling and in directional drilling where no change in direction during the drilling process is required or intended. Second, the drill bit may be rotated by a downhole motor that is powered, for example, by the circulation of fluid supplied from the surface. This technique, sometimes called "slide drilling," is typically used in directional drilling to effect a change in direction of a wellbore, such as in the building of an angle of deflection, and almost always involves the use of specialized equipment in addition to the downhole drilling motor. Third, rotation of the drill string may be superimposed upon rotation of the drilling bit by the downhole motor.

In the drill string, the bottom-hole assembly is the lower portion of the drill string consisting of the bit, the bit sub, a drilling motor, drill collars, directional drilling equipment and various measurement sensors. Typically, drilling stabilizers are incorporated in the drill string in directional drilling. The primary purpose of using stabilizers in the bottom-hole assembly is to stabilize the bottom-hole assembly and the drilling bit that is attached to the distal end of the bottom-hole assembly, so that it rotates properly on its axis. When a bottom-hole assembly is properly stabilized, the weight applied to the drilling bit can be optimized.

A secondary purpose of using stabilizers in the bottom-hole assembly is to assist in steering the drill string so that the inclination of the wellbore can be controlled. For example, properly positioned stabilizers with predetermined outer diameter can assist either in increasing or decreasing the deflection angle of the wellbore either by supporting the drill string near the drilling bit or by not supporting the drill string near the drilling bit. The number of stabilizers on the bottom-hole assembly, the position on the drill string and the outer diameter of each one could give rise to a fulcrum effect which helps in building inclination or a pendulum effect which helps in dropping inclination. For bottom-hole assemblies with three or more stabilizers properly spaced, the result could be a combination of both principles which gives rise to holding the angle.

Conventional stabilizers can be divided into two broad categories. The first category includes rotating blade stabilizers which are incorporated into the drill string and either rotate or slide with the drill string. The second category includes non-rotating sleeve stabilizers which typically comprise a ribbed sleeve rotatably mounted on a mandrel so that, during drilling operations, the sleeve does not rotate while the mandrel rotates or slides with the drill string. Some stabilizers have blades that are of a fixed gauge and other stabilizers, typically referred to as adjustable gauge stabilizers, have the ability to adjust the gauge during the drilling process.

Although a stabilizer having straight blades is suitable for slide drilling, straight blades tend to cause shock and vibration in the bottom-hole assembly when rotary drilling. Wrapped blades can limit vibration in the bottom-hole assembly when the drill string is rotated. However, during slide drilling, wrapped blades tend to "corkscrew" themselves into a tight wellbore and get stuck.

While some stabilizers support extension and retraction of pistons to vary the diameter of the stabilizer, existing stabilizers allow only two piston positions while drilling: a flush position and an extended position. This limits the precision to which the inclination of the borehole can be controlled. With only two positions, the flush position may build inclination too aggressively, while the extended position could drop inclination too quickly.

SUMMARY OF INVENTION

In one aspect, an adjustable gauge drilling stabilizer comprises a tubular body member; and a plurality of blade members extending radially outward from said tubular body member and arranged circumferentially on said tubular body member, each blade member having a leading end portion and a trailing end portion with an angular shaped profile portion between the leading end portion and the trailing end portion; a plurality of pistons, disposed in the blade members, operable for radial extension and retraction, each of the pistons having a plurality of piston extension positions, comprising a fully retracted position, a fully extended position, and at least one intermediate extension position; and a cam, disposed within the tubular body member and movable in a longitudinal direction along an axis of the tubular body member, having a neutral position and a plurality of index positions, each corresponding to one of the plurality of piston extension positions, wherein the cam is configured to move from a first index position to a second index position without engaging in any other of the plurality of index positions.

In another aspect, a method of adjusting an adjustable gauge drilling stabilizer, comprises returning a cam member of the adjustable gauge drilling stabilizer to a neutral position at pump shutoff; disengaging the cam member from a first index position and engaging the cam member at a second index position without engaging the cam member at any intermediate index position between the first index position and the second index position; extending or retracting a piston of the adjustable gauge drilling stabilizer to a position corresponding to the second index position of the cam member.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
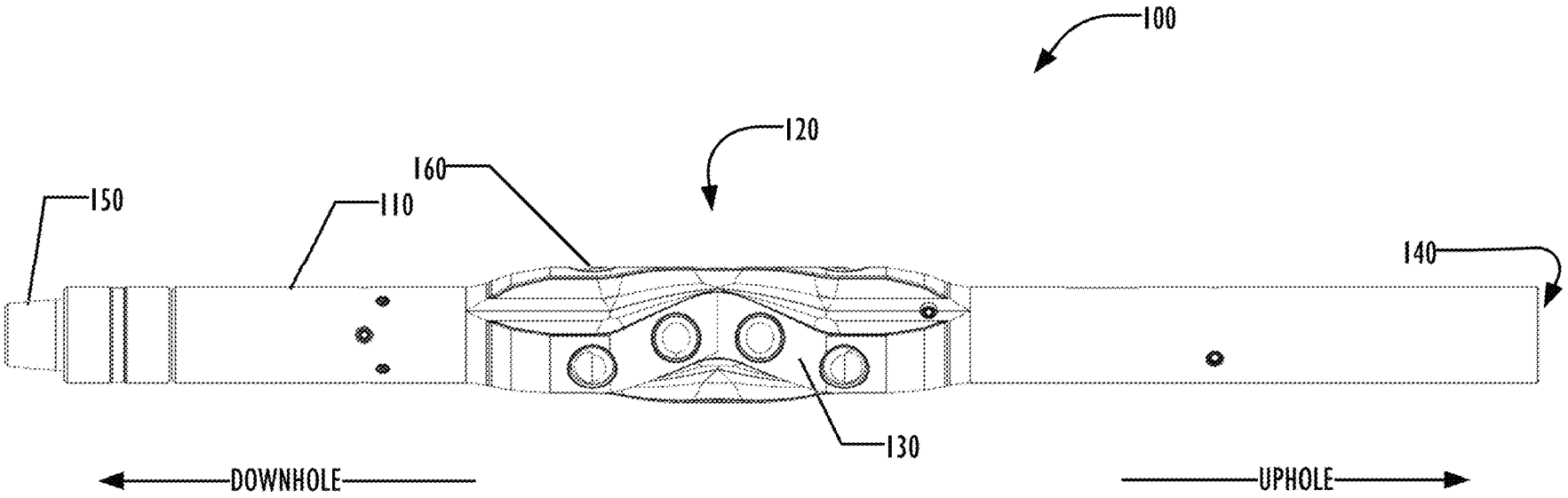
FIGS. 1 and 2 are side views of a stabilizer sub according to one embodiment.

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts are understood to reference all instance of subscripts corresponding to the referenced number. Moreover, the language used in this disclosure has been principally selected for readability and instructional purposes and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

As used herein, the term "downhole" refers to the direction along the axis of the wellbore towards the furthest extent of the wellbore and the drill bit location. Similarly, the term "uphole" refers to the direction along the axis of the wellbore that leads back to the surface, or away from the drill bit. In a situation where the drilling is along essentially a vertical path relative to the surface of the land or water, downhole is truly in the down direction, and uphole is truly in the up direction. However, in horizontal drilling, the terms up and down are ambiguous, so the terms downhole and uphole are used to designate relative positions along the drill string.

As used herein, in a wellbore that is not fully vertical, the "high" side of the wellbore and the "low" side of the wellbore refer, respectively, to those points on the circumference of the wellbore that are closest, and farthest, from the surface of the land or water.

The variable gauge stabilizer described below uses extendible pistons to vary the diameter of the stabilizer and allows for intermediate positions, spaced as desired, between the flush and fully extended positions. This allows for more precise control over inclination and allows for a selection that can more easily maintain a preferred well profile.

To provide this additional functionality, a barrel cam is used to limit the longitudinal movement of the internal mandrel, thereby controlling the extension of the pistons. In some prior stabilizers, a fixed, repeating profile alternates between flush and extended piston positions with each cycling of the drilling pumps, with pins rotationally fixed to a stabilizer body and following a groove within the barrel cam. Through the axial motion of the mandrel, the pins act to index the barrel cam, limiting the downhole axial motion of the mandrel, depending on the position of the barrel cam. As the barrel cam can be indexed with each pump cycle, the barrel cam follows a pattern of flush-extended-flush-extended.

The stabilizer described below includes a profile with a plurality of discrete axial pathways, each with different limiting positions. Each of these positions corresponds to an extension position of the pistons whereby the build and drop behavior of the drilling assembly becomes one with intermediate extension positions between the flush and fully extended positions.

An electric motor can control the indexing of the barrel cam. This provides the capability to select which piston extension distance is desired and maintain that piston position until a new piston position is required. This has the added benefit of eliminating the requirement to cycle drilling pumps multiple times whenever a new section of drill pipe is added to the drill string on the surface. In one embodiment, each time the pumps are turned off, the electric motor may change the current position setting by rotating the barrel cam so that the pins are aligned with a new pathway. The pins will encounter a stop placed at a different axial position the next time the pumps are engaged. Thus, the barrel cam can go from any axial position to any other axial position without traversing intermediate positions, causing the pistons of the drilling stabilizer to extend or retract from any extension to any desired extension without engaging the barrel cam at each intermediate position. In some embodiments, an electronic control system comprised of battery pack(s), an electronic circuit board with sensors and motor circuitry, and an electric motor can rotate the barrel cam to the selected position.

A signal may be sent from surface using various techniques including: varying the rotation of the drill pipe in a determined pattern of speed and duration that can be detected by vibration sensors; selectively bypassing drilling fluid on the surface to create a pressure pulse that may be detected by pressure sensors downhole; engaging and disengaging the pumps in a set pattern; by use of an electromagnetic antenna to send a signal through the formation that can be detected by an antenna in the electronics assembly; through an acoustic signal sent from nearby equipment fitted with an acoustic transmitter. The onboard electronics can then store this signal and index the barrel cam the next time the pumps are turned off.

In some embodiments, a position indicator provides a signal of the current poppet position to the surface. In one embodiment, this indicator consists of a poppet and an orifice, which when engaged, create a pressure restriction that can be monitored from the surface. A stepped profile on the poppet creates an increasing restriction as the poppet increasingly engages in the orifice, corresponding to each piston position. Alternate forms of the flow restriction geometry may be used to achieve the same effect.

Figure 2:
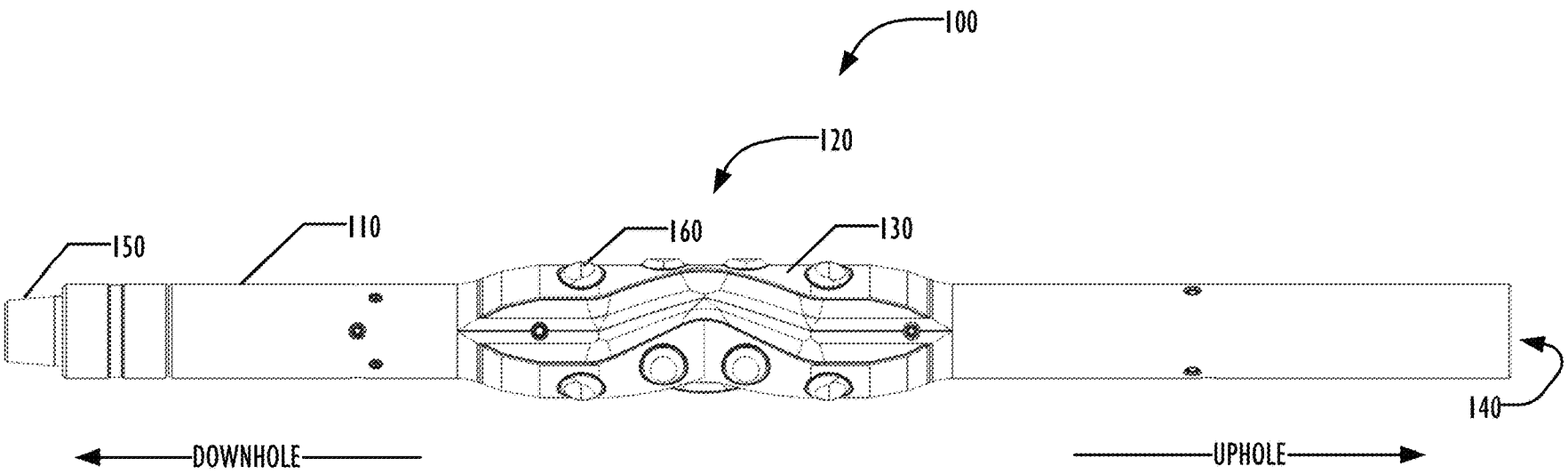

FIGS. 1 and 2 are two side views that illustrate an adjustable gauge drilling stabilizer 100 according to one embodiment. In this embodiment, the drilling stabilizer 100 comprises a tubular body member 110 and a stabilizer blade area 120 having a plurality of blade members 130. The stabilizer blade area 120 is centered in the illustrated embodiment along the tubular body member 110 of the drilling stabilizer. Mechanical couplings, such as threaded end sections, comprise uphole coupling 140 and downhole coupling 150 at the uphole and downhole ends, respectively, of the body member 110. The couplings 140 and 150 are used to attach the tubular body member 110 of the drilling stabilizer 100 at various locations within a drill string or bottom-hole assembly. The drilling stabilizer can be used in a conventional rotary bottom-hole assembly, or positioned either above or below a steerable motor, as is known in the art of directional drilling. The piston elements 160 are located and within each blade member 130 in the blade area 120. In FIG. 2, the piston elements 160 are extended at least partially; and in FIG. 1, the piston elements 160 are retracted, at least partially. Although the drilling stabilizer 100 of FIGS. 1 and 2 illustrates an example with four piston elements 160 per blade member 130, other numbers of piston elements can be used as desired.

Figure 3:
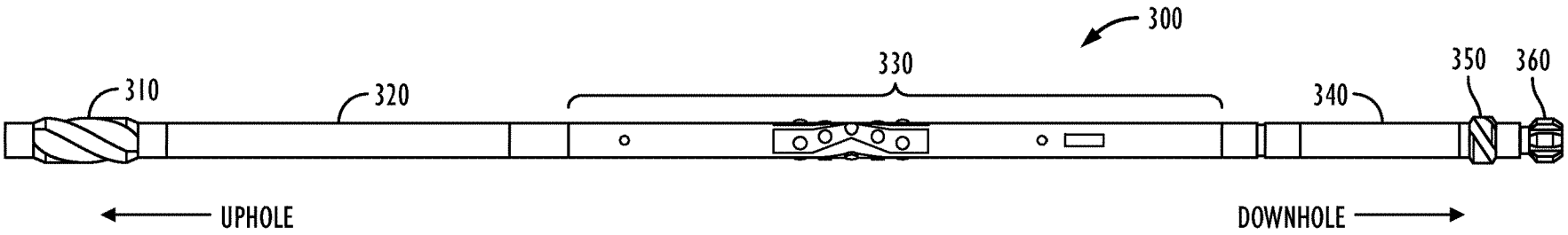
FIGS. 3 and 4 are two example configurations in which a stabilizer sub is deployed.
Figure 4:
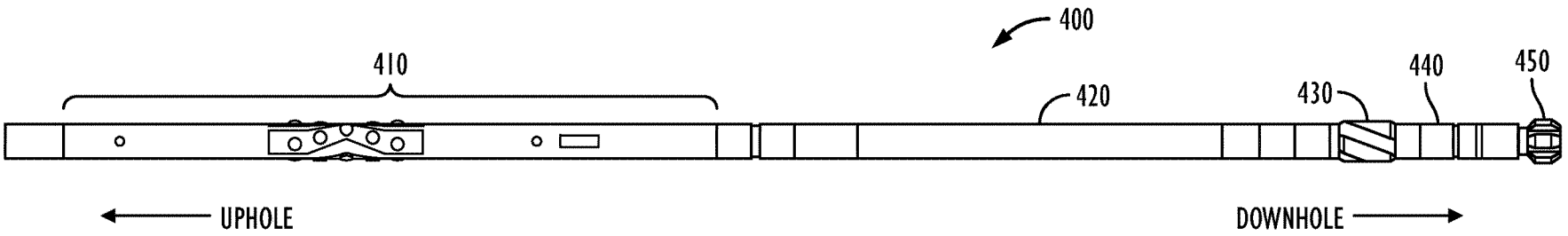

FIGS. 3 and 4 illustrate two example ways in a drilling stabilizer can be used. In FIG. 3, a bottom hole assembly 300 without a mud motor is illustrated. A conventional wrapped stabilizer 310 is positioned at an uphole end of the bottom hole assembly 300. A drill collar 320 connects stabilizer 310 to stabilizer sub 330, which corresponds to the drilling stabilizer 100 of FIGS. 1 and 2. Another drill collar 340 connects stabilizer sub 330 to a short wrapped stabilizer 350, to which is connected drill bit 360. In FIG. 4, another bottom hole assembly 400 is illustrated. In this configuration, a drilling stabilizer 410 corresponding to the drilling stabilizer 100 of FIGS. 1 and 2 is connected to a mud motor 420, which in turn is connected to a screw-on sleeve stabilizer on a bearing pack 430, a bit box 440, and a drill bit 450. Other bottom hole assembly configurations can be assembled as desired.

Figure 5:
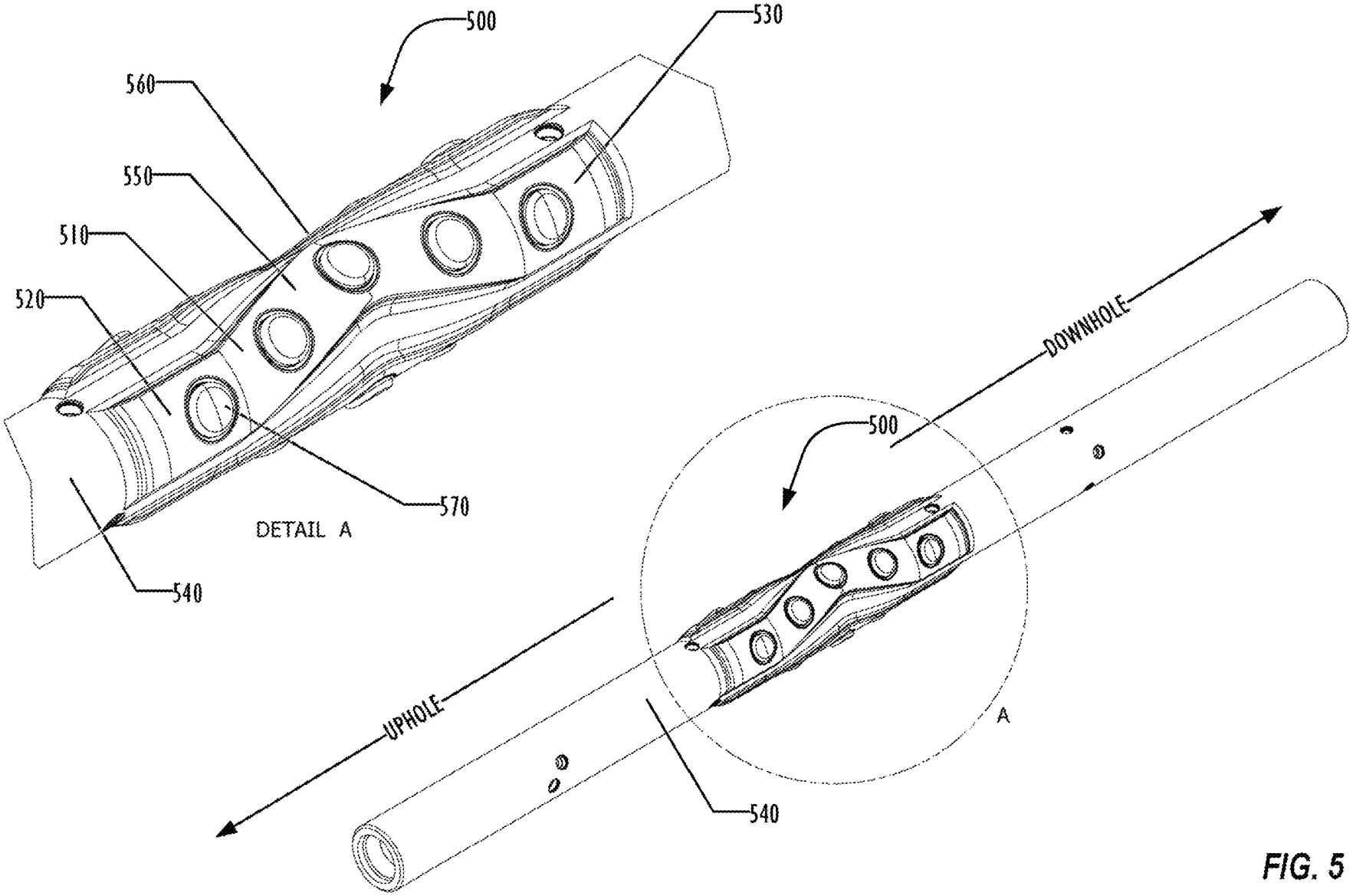
FIG. 5 is an isometric view of a drilling stabilizer sub, including a detailed view of a blade portion of the drilling stabilizer according to one embodiment.

FIG. 5 is an isometric view of a drilling stabilizer sub including a detailed view of a blade portion of a drilling stabilizer 500 corresponding to drilling stabilizer 100 of FIG. 1 according to one embodiment. Each blade member 510 comprises an uphole straight portion 520 located at the uphole end-portion of the blade member 510, also referred to as the trailing end portion, and a downhole straight portion 530 located at the downhole end-portion of the blade member 510, also referred to as the leading end portion. The uphole and downhole straight portions 520 and 530 each have a longitudinal axis which is in substantial alignment with the longitudinal axis of the tubular body member 540 on which the blade portion is disposed. Located between the uphole straight portion 520 and the downhole straight portion 530 is an angular shaped profile portion, also referred to as the angular profile 550. The angular profile 550 in one embodiment comprises a chevron or V-shaped portion having an apex 560. In the preferred embodiment the apex 560 of each angular profile 550 of each blade member 510 are in circumferential alignment. In this example, there are three blade members 510 each containing five piston elements 570; in other examples different numbers of blade members 510 and piston elements 570 may be used. The piston elements 570 are operable for radial extension and retraction with a plurality of piston extension positions, including a fully retracted position, a fully extended position, and one or more intermediate positions. As described below, the piston elements 570 have three intermediate positions, but any desired number of intermediate positions may be used.

Figure 6:
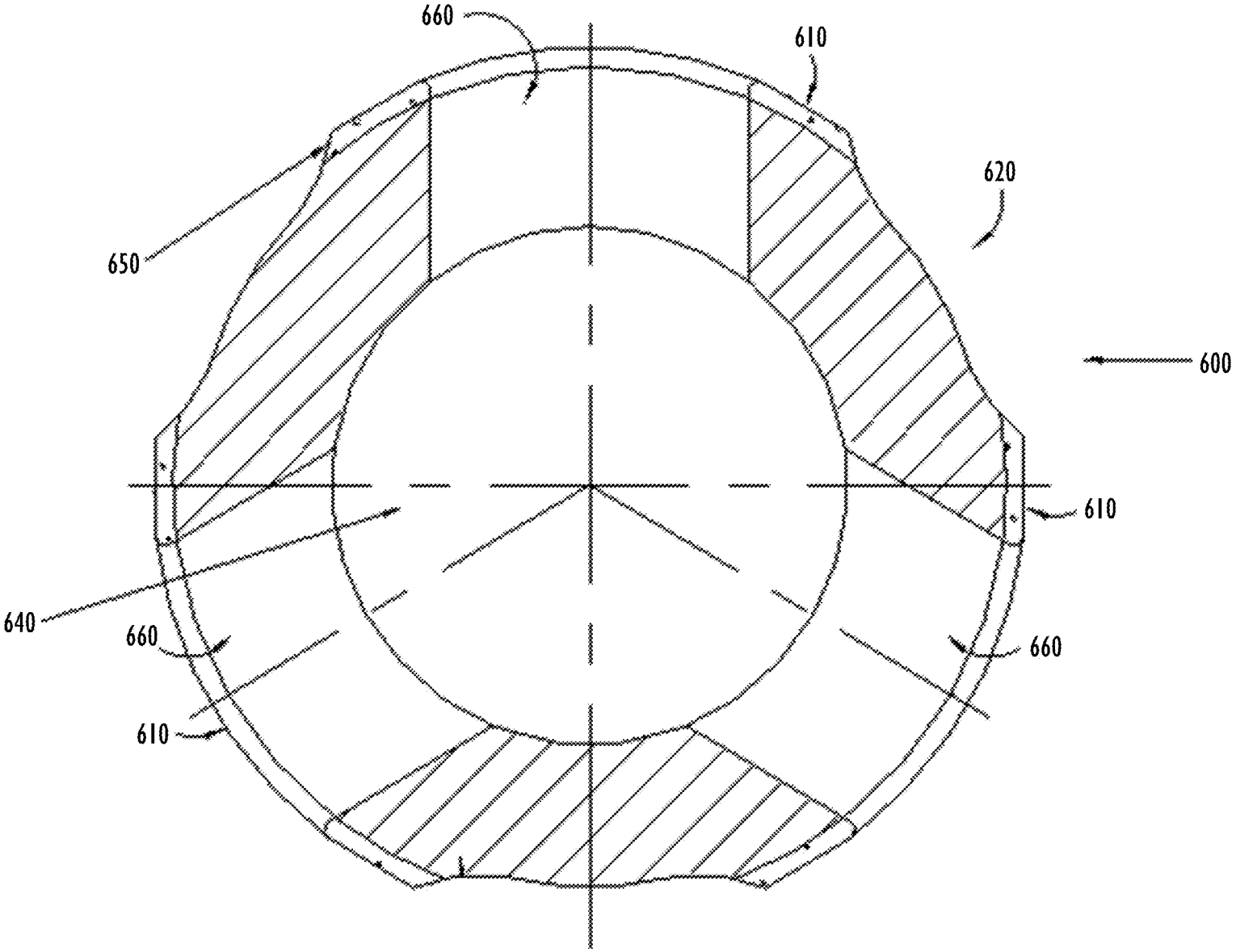
FIG. 6 is a cross-sectional view of a drilling stabilizer according to one embodiment.

FIG. 6 is a cross-sectional view illustrating a drilling stabilizer blade area 600 corresponding to the blade area 120 of FIG. 1. In this example, the blade area 600 comprises three stabilizer blades 610 forming groove portions 620 between the stabilizer blade members 610 for fluid flow on the outside of the blade area 600. Passageway 640 allows for the flow of drilling fluids through the tubular member (not illustrated in FIG. 6 for clarity of the drawing) on which the blade area 600 is disposed. The stabilizer blade members 610 extend radially outward from the axis of the tubular body member. Each blade member 610 is comprised of a hardfacing surface 650, which is capable of withstanding contact with the wall of the wellbore during drilling operations. The hardfacing surface 650 represents the outermost diameter of each blade member 610. As illustrated, the hardfacing surface 650 presents an arc shape for conformance with the wall of the borehole. The piston ports 660 are located within and along the length of each blade member 610.

In one embodiment, illustrated in FIGS. 7-12, a multi-position drilling stabilizer corresponding to the drilling stabilizer 100 of FIGS. 1-2 is a hydraulically activated integral blade stabilizer with three spiral blades. Each blade carries four pistons 160 which are extended by the differential pressure between the inside of the tool and the annulus when drilling pumps are on. These pistons are then brought to below flush of the blades by a spring when the pumps are off. The pressure drop through the tool itself is minimal when the pistons are retracted (flush gauge position), but as the pistons are extended through the multiple extended positions, an increasing amount of pressure drop occurs.

In one embodiment, the drilling stabilizer 100 has a neutral position (when pumps are off) and five operating positions: ranging from pistons retracted (flush gauge), when the pistons are flush with the outer diameter of the blade, to a fully extended (full gauge) position, in which the pistons extend a full distance beyond the outer diameter of the blade, and three intermediate extensions. Other embodiments may use different numbers of operating positions, with different numbers of partially extended intermediate positions. Different embodiments may use any desired full extension amount beyond the outer diameter, for example, ¼ inch (6.4 mm), 5/16 inch (7.9 mm), and ½ inch (12.7 mm).

Thus, the actual gauge diameter of the drilling stabilizer 100 changes between the retracted and the fully extended configuration, based on the amount of extension of the pistons 160.

Figure 7:
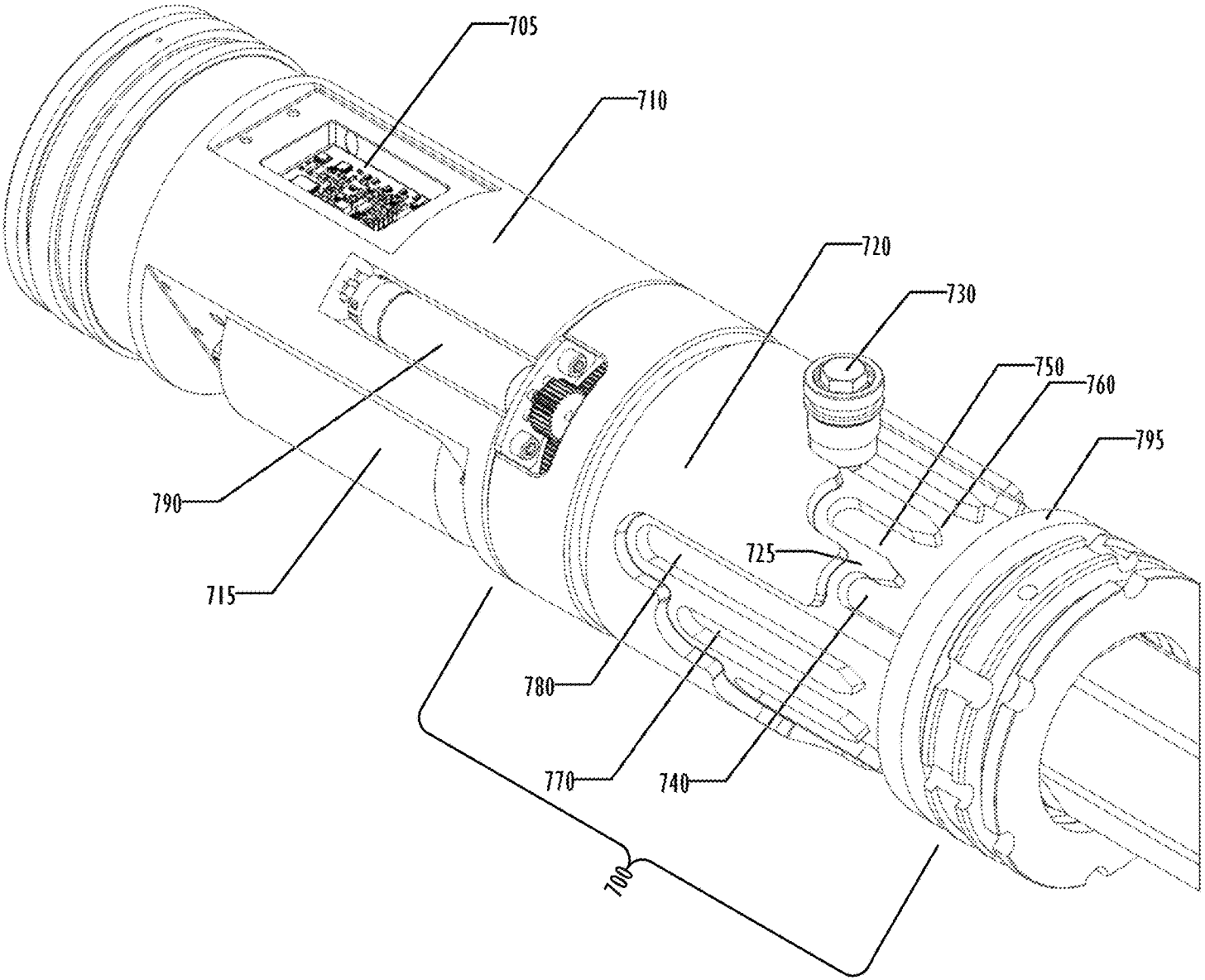
FIG. 7 is an isometric view of a barrel cam of a drilling stabilizer that controls the various extension positions of stabilizer pistons according to one embodiment.

Turning now to FIG. 7, an isometric view illustrates a barrel cam 700 of a drilling stabilizer 100 that controls the various extension positions of stabilizer pistons according to one embodiment. The barrel cam 700 is movable in a longitudinal direction along the axis of a tubular member of the drilling stabilizer 100 as well as rotatable about that axis.

In this view, a motor section 710 provides motive power to rotate the barrel cam about the central axis of the drilling stabilizer 100. A motor 790, in some embodiments a stepper motor, causes the barrel cam 700 to rotate, allowing pins 730, fixedly mounted to an outer portion of the drilling stabilizer, to engage and disengage with one of index positions or slots 740, 750, 760, 770, and 780 as the barrel cam moves in a downhole or uphole direction along the central axis of the drilling stabilizer 100. Each of slots 740, 750, 760, 770, and 780 correspond to one of the extension positions of the corresponding pistons. A plurality of pins 730 and slots 740, 750, 760, 770, and 780 may be included to improve mechanical properties of the assembly. The slots 740, 750, 760, 770, and 780 are configured for engagement with the pins 730. In this example, the shortest slot 740 corresponds to the fully retracted position of the pistons, the longest slot 780 corresponds to the fully extended position, and intermediate slots 750, 760, and 770 correspond to increasingly extended intermediate positions of the pistons, respectively. An area 720 that surrounds the barrel cam 700 and a raised area 725 forming and surrounding each of the slots 740, 750, 760, 770, and 780 engages with a portion of the pins 730 for stability and define the range of movement of the pin 730 relative to the barrel cam 700. A stop ring 795 provides a stop for the pin 730, to limit the motion of the barrel cam 700 relative to the pin 730. When the pin 730 is adjacent the stop ring 795, the motor 790 may rotate the barrel cam 700, allowing the pin to align with a different one of slots 740, 750, 760, 770, and 780. An electronic control board 705 may be used on the motor section 710 for detecting the surface commands and to control the rotation of the barrel cam 700. The electronic control board 705 and the motor 790 may be powered by a battery pack 715 located on the motor section 710.

Figure 8A:
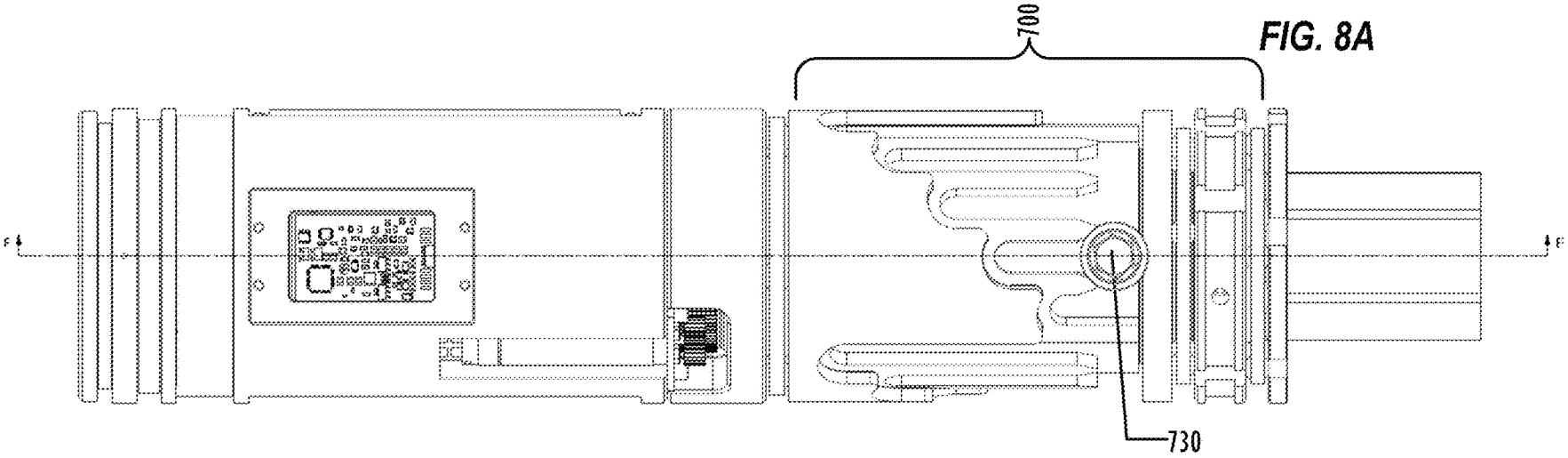
FIGS. 8A and 8B are a side view and a cutaway view, respectively, of the barrel cam of FIG. 7 in a configuration that allows movement from one extension position to another according to one embodiment.
Figure 8B:
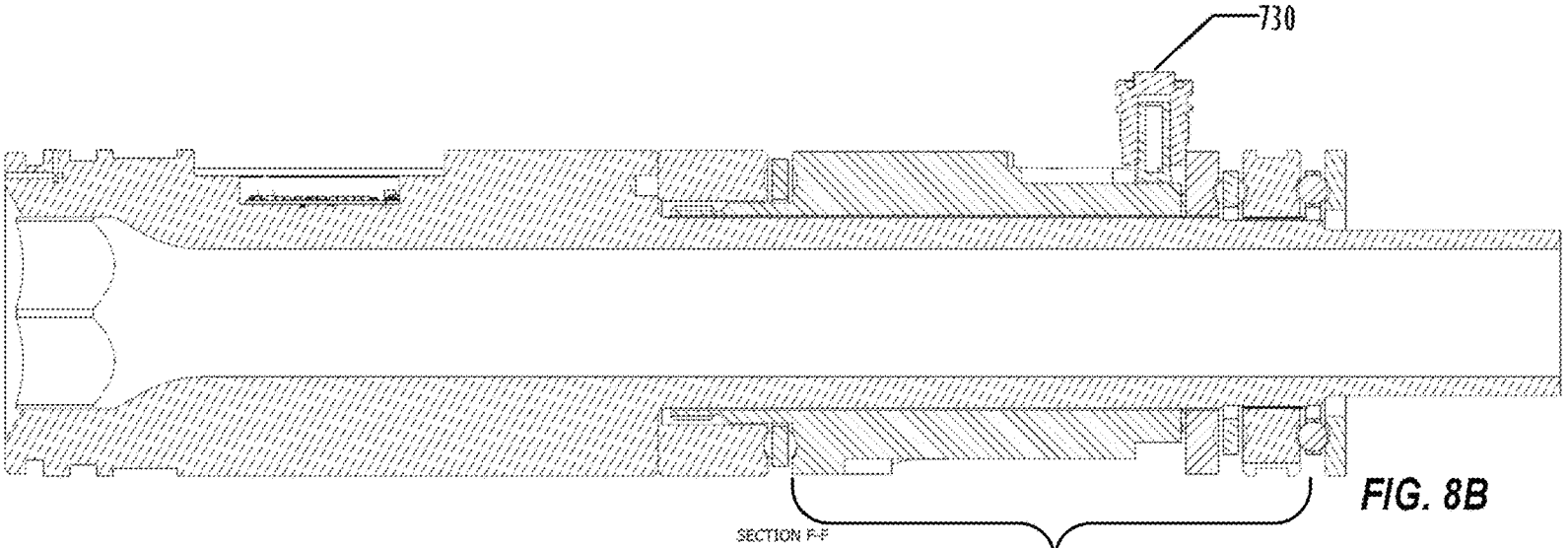
Figure 9A:
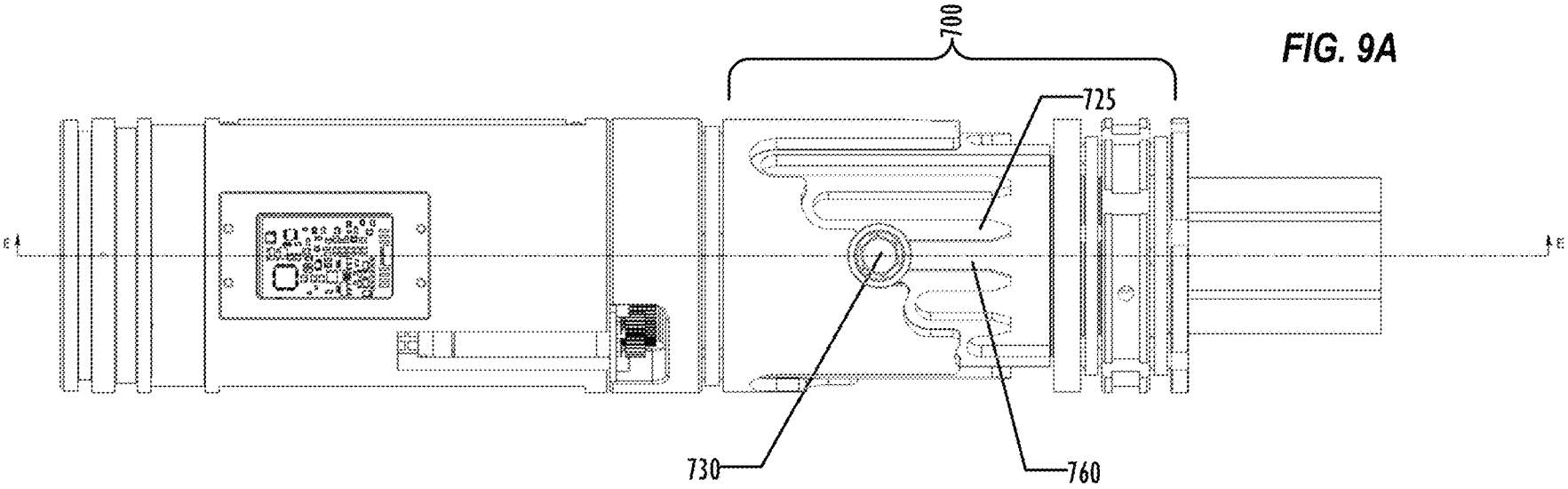
FIGS. 9A and 9B are a side view and a cutaway view, respectively, of the barrel cam of FIG. 7 in a configuration that provides an intermediate extension of pistons according to one embodiment.
Figure 9B:
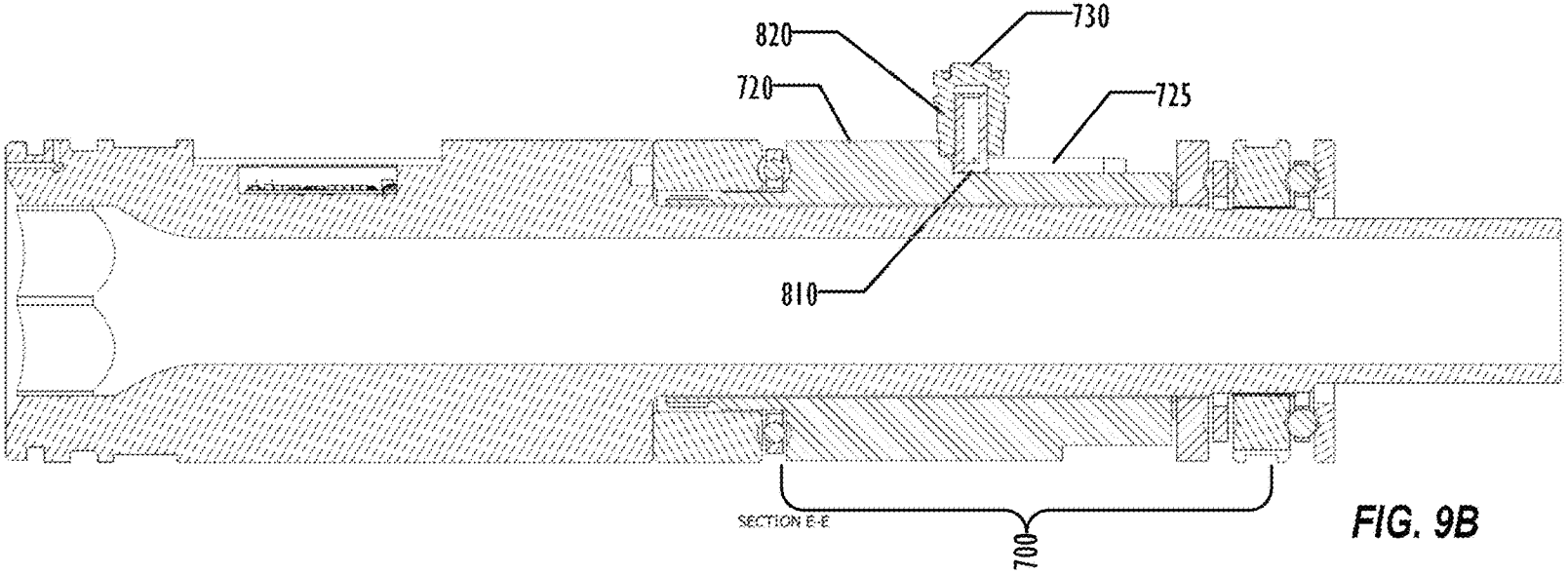

FIGS. 8A and 8B are side and cutaway views, respectively, of the barrel cam 700 according to one embodiment, with the barrel cam 700 having moved to a position such that pin 730 is not engaged with any of slots 740, 750, 760, 770, and 780, but is in a position to allow rotation of the barrel cam 700 as driven by motor 790 so that the pin 730 can engage with a desired slot 740, 750, 760, 770, or 780. FIGS. 9A and 9B are side and cutaway views, respectively, of the barrel cam 700 according to one embodiment, with the barrel cam 700 having moved to a position such that pin 730 is engaged in slot 760. In this example, pin 730 has a central portion 810 that engages with the raised area 725 that form the slot 760 and a side portion 820 of pin 730 that engages with the area 720. Other configurations of the pin 730 and barrel cam 700 may be used to direct the movement of the pin relative to the barrel cam 700.

Figure 10:
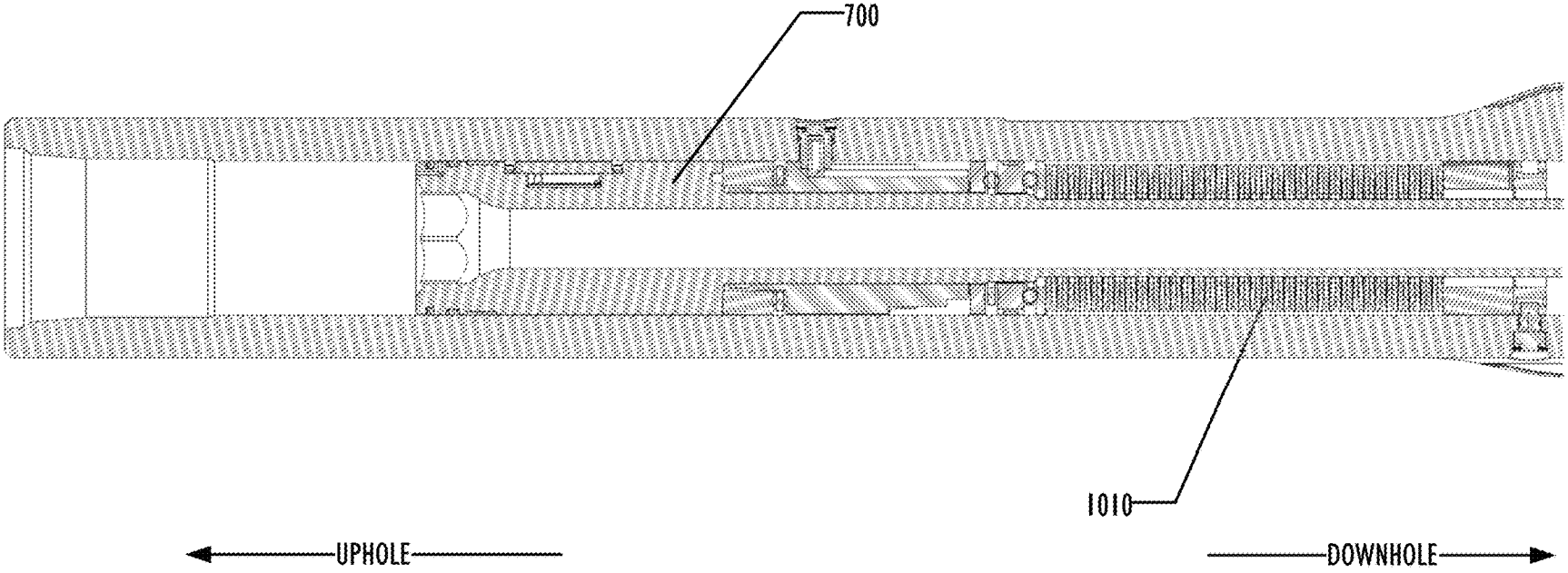
FIG. 10 is a cutaway side view of a motor section of the barrel cam of FIG. 7 according to one embodiment.

FIG. 10 is a cutaway view of a drilling stabilizer 100 illustrating a way in which the inner mandrel is biased to return to the neutral position of the barrel cam 700 upon pump shutoff, according to one embodiment. In this example, a spring 1010 is used to move barrel cam 700 and inner mandrel in an uphole direction when not under pressure from the pump. When the pumps are shut off, the spring 1010 decompresses pushing the barrel cam 700 in the uphole direction, disengaging the pin 730 from its current slot and returning the barrel cam to its neutral position. The barrel cam 700 may be rotated so the pin 730 is positioned into one of the slots 740, 750, 760, 770, and 780. When the pumps are turned back on, the spring 1010 is compressed, pushing the barrel cam 700 in a downhole direction, engaging the pin 730 into its currently aligned slot, extending the pistons the associated distance. Other techniques can be used to bias the barrel cam 700 to return to the neutral state upon pump shutoff.

Figure 11:
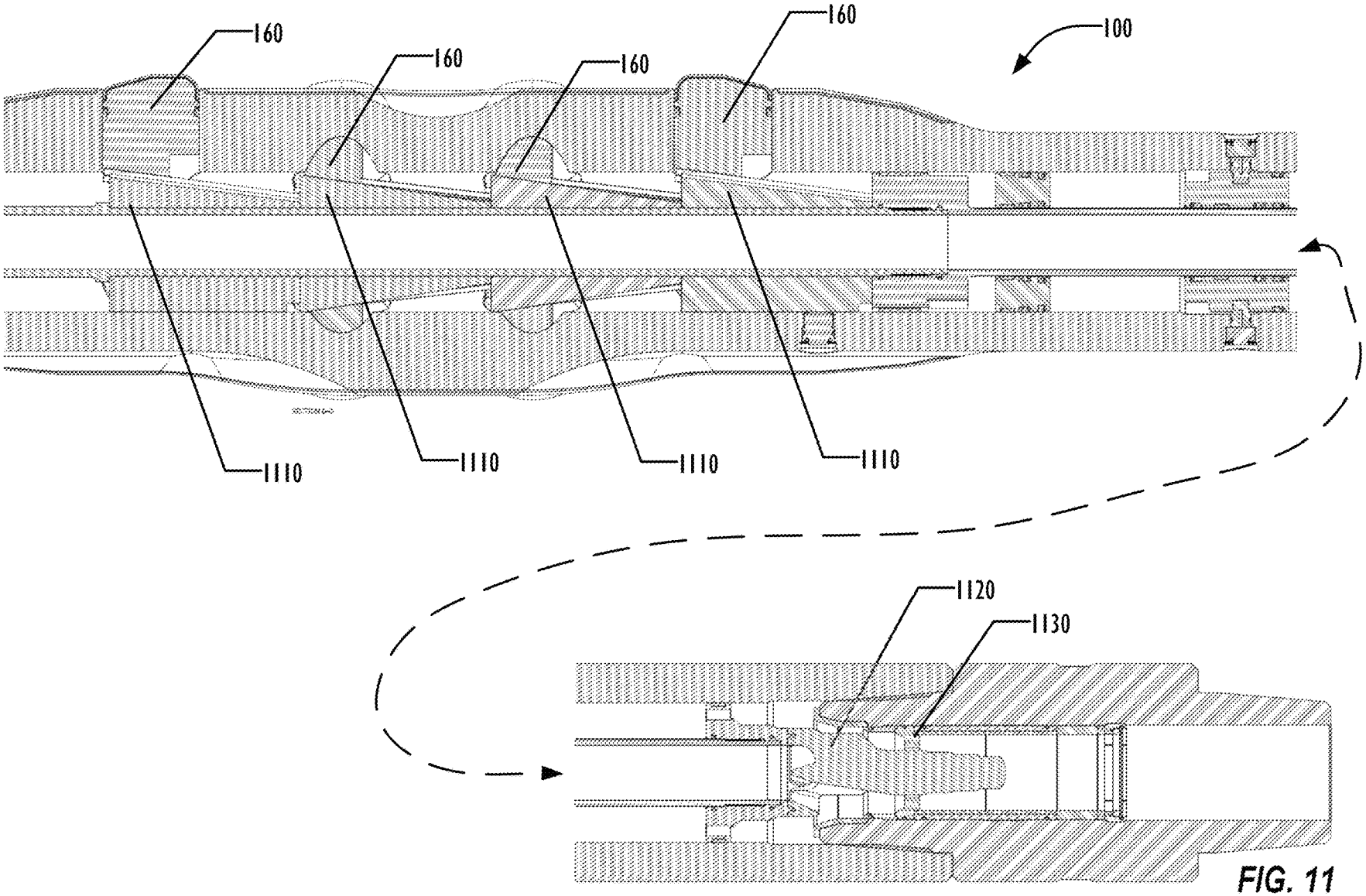
FIG. 11 is a cutaway view of drilling stabilizer according to one embodiment, illustrating a mechanism for extending pistons.

FIG. 11 is a cutaway view of another portion of a drilling stabilizer 100 according to one embodiment. In this view, piston ramps 1110 are moved in a downhole direction in operation by fluid pressure. Each of the pistons 160 is urged radially outward by one of the piston ramps 1110, with the amount of extension dependent on the position of the piston 160 relative to the corresponding piston ramp 1110. Because each of slots 740, 750, 760, 770, and 780 allows the barrel cam 700 to move downhole a different amount, rotating the barrel cam 700 to allow pin 730 to engage with one of the slots 740, 750, 760, 770, and 780 allows the piston ramps 1110 to urge the pistons 160 radially outward a different distance, providing for variable extension of the pistons 160.

As illustrated in FIG. 11, a poppet 1120 and orifice 1130 according to one embodiment provide a position indicator that can generate a signal of the current poppet position to the surface. When engaged, the poppet 1120 and orifice 1130 create a pressure signal by the pressure restriction that can be monitored from the surface. A stepped profile on the poppet 1120 creates an increasing restriction as the poppet 1120 increasingly engages in the orifice 1130, corresponding to each piston position. Alternate forms of the flow restriction geometry may be used to achieve the same effect.

Figure 12A:
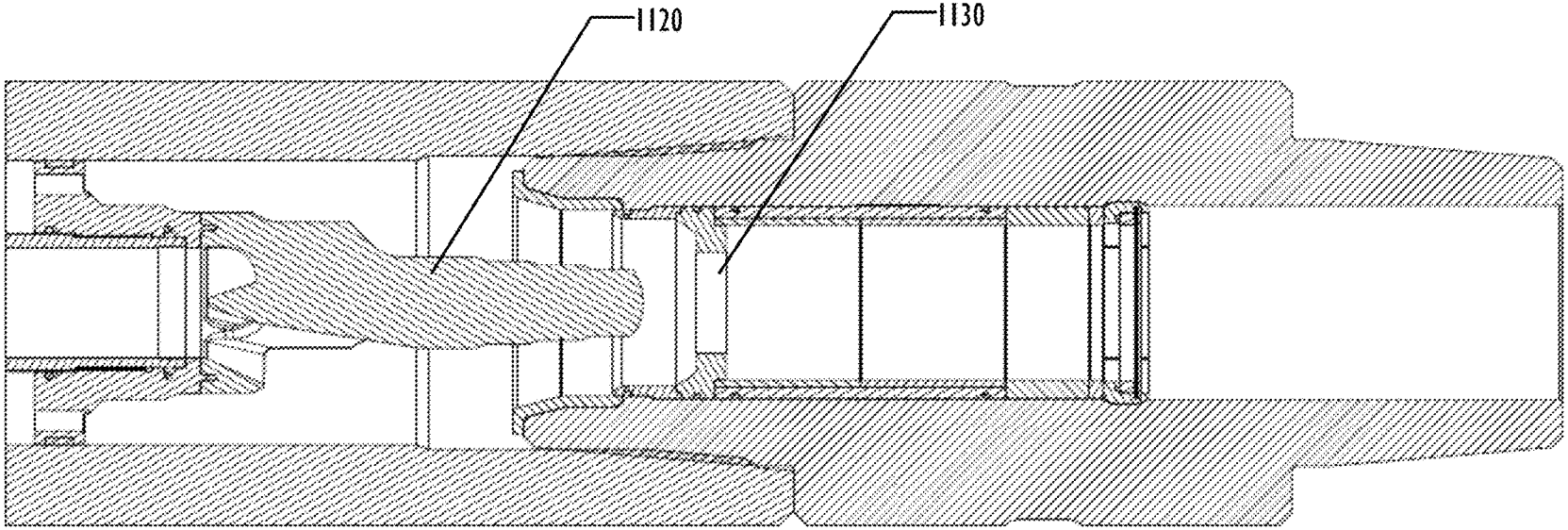
FIGS. 12A and 12B are cutaway side views of an orifice and poppet element for indicating movement of the piston extension mechanism of a drilling stabilizer according to one embodiment.
Figure 12B:
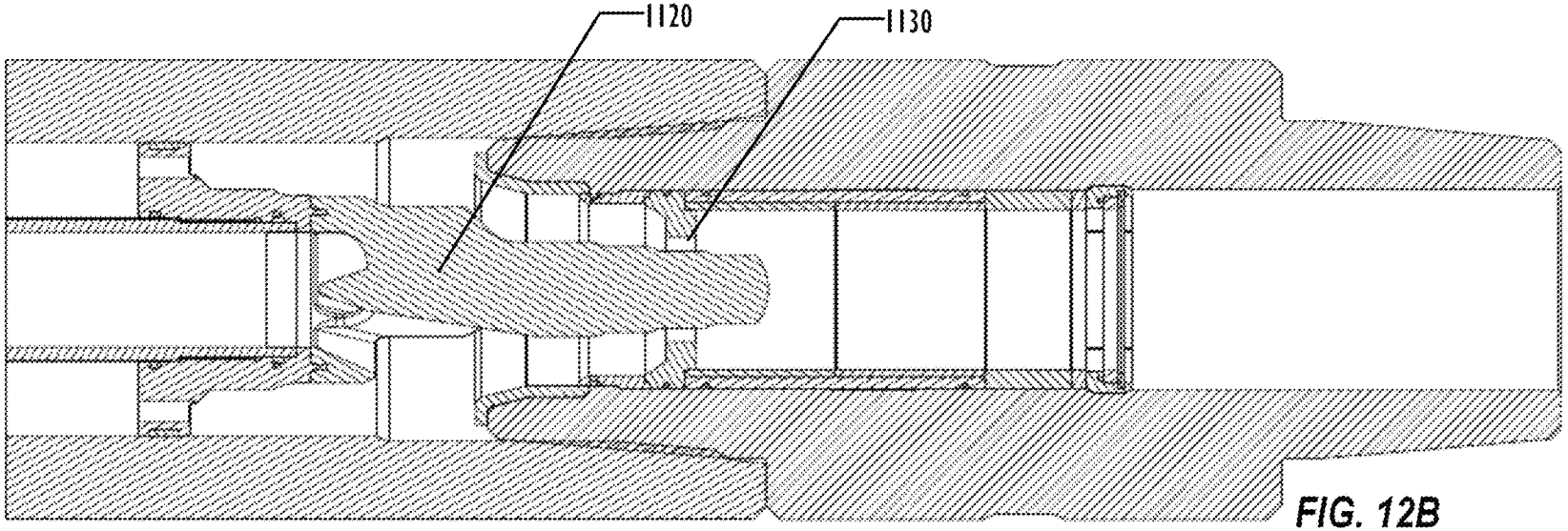

FIGS. 12A and 12B are cutaway views illustrating two positions of the poppet 1120 relative to orifice 1130, corresponding to two extension positions of the pistons 160. In FIG. 12A, poppet 1120 is in a retracted position, which corresponds to the neutral state of the barrel cam 700, and a fully retracted position of pistons 160. In FIG. 12B, poppet 1120 is in position 3, corresponding to the pin 730 being in slot 760, corresponding to an intermediate extension of the pistons 160. By using the pressure drop caused by the poppet 1120 and orifice 1130 to signal the current poppet 1120 position, and thus the current piston 160 extension, an operator uphole can determine the current rotational position of the barrel cam 700 and generate desired commands to the motor 790 to rotate the barrel cam 700 to a desired position to cause the pistons 160 to be extended a desired amount. Although, as illustrated in the Figures, the barrel cam 700 is configured with slots 740, 750, 760, 770, and 780 that result in uniform extension differences between positions, embodiments may design the slots 740, 750, 760, 770, and 780 to allow for non-uniform extension differences if desired.

The above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

We claim:

1. An adjustable gauge drilling stabilizer, comprising:

a tubular body member; and a plurality of blade members extending radially outward from said tubular body member and arranged circumferentially on said tubular body member, each blade member having a leading end portion and a trailing end portion with an angular shaped profile portion between the leading end portion and the trailing end portion;

a plurality of pistons, disposed in the blade members, operable for radial extension and retraction, each of the pistons having a plurality of piston extension positions, comprising a fully retracted position, a fully extended position, and at least one intermediate extension position; and a cam, disposed within the tubular body member and movable in a longitudinal direction along an axis of the tubular body member, having a neutral position and a plurality of index positions, each corresponding to one of the plurality of piston extension positions; and a motor coupled to the cam, configured to rotate the cam relative to the tubular body member, wherein the cam is configured to move from a first index position to a second index position without engaging in any other of the plurality of index positions.

2. The adjustable gauge drilling stabilizer of claim 1, further comprising:

a pin, rotationally fixed to the tubular body member, wherein the cam comprises:

a barrel cam, formed with a plurality of slots configured for engagement with the pin, each of the plurality of slots corresponding to one of the plurality of index positions.

3. The adjustable gauge drilling stabilizer of claim 1, further comprising:

an inner mandrel, coupled to the cam; and a plurality of piston ramps, disposed on the inner mandrel, each piston ramp configured to engage with one of the plurality of pistons for extending or retracting the plurality of pistons.

4. The adjustable gauge drilling stabilizer of claim 1, further comprising:

an orifice disposed within the tubular body member; and a poppet coupled to the cam and movable relative to the orifice for causing a pressure signal detectable at an uphole location, wherein the pressure signal indicates a corresponding index position of the cam.

5. The adjustable gauge drilling stabilizer of claim 4, wherein the poppet comprises a stepped profile, each step of the stepped profile corresponding to one of the plurality of index positions.

6. The adjustable gauge drilling stabilizer of claim 1, wherein the cam automatically returns to the neutral position upon shutoff of a pump pressurizing fluid within the tubular body member.

7. The adjustable gauge drilling stabilizer of claim 6, further comprising a spring, coupled to the cam and biased to cause the cam to return to the neutral position upon shutoff of the pump.

8. The adjustable gauge drilling stabilizer of claim 1, further comprising:

an electronic control board; and a battery pack, connected to the electronic control board.

9. The adjustable gauge drilling stabilizer of claim 8, wherein the electronic control board is configured to:

detect a surface command; and control movement of the cam responsive to the surface command.

10. A method of adjusting an adjustable gauge drilling stabilizer, comprising:

returning a cam member of the adjustable gauge drilling stabilizer to a neutral position at shutoff of a pump pressurizing fluid within a tubular body member of the adjustable gauge drilling stabilizer;

disengaging the cam member from a first index position;

rotating the cam member by a motor coupled to the cam member to align a pin with a slot formed in the cam member corresponding to a second index position;

engaging the cam member at the second index position without engaging the cam member at any intermediate index position between the first index position and the second index position; and extending or retracting a piston of the adjustable gauge drilling stabilizer to a position corresponding to the second index position of the cam member.

11. The method of claim 10, wherein returning the cam member of the adjustable gauge drilling stabilizer to the neutral position at shutoff of the pump comprises: urging the cam member in an uphole direction using a spring coupled to the cam member and a body of the adjustable gauge drilling stabilizer.

12. The method of claim 10, wherein the cam member is a barrel cam having a plurality of slots, each corresponding to one of an index position of the barrel cam, wherein disengaging the cam member from the first index position comprises moving the barrel cam in an uphole direction, disengaging the pin from a first slot of the plurality of slots, and wherein engaging the cam member at the second index position comprises:

rotating the barrel cam about an axis of the adjustable gauge drilling stabilizer to align the pin with a second slot of the plurality of slots; and moving the barrel cam in a downhole direction, engaging the pin with the second slot.

13. The method of claim 10, further comprising:

signaling a position of the cam member to an uphole location.

14. The method of claim 13, wherein signaling the position of the cam member comprises:

moving a poppet member coupled to the cam member relative to an orifice; and generating a pressure pulse responsive to the moving of the poppet member.

15. The method of claim 10, wherein extending or retracting the piston comprises:

urging the piston radially outward by a piston ramp member coupled to the cam member.

16. The method of claim 10, further comprising:

detecting a surface command at the adjustable gauge drilling stabilizer; and controlling a position of the cam member responsive to the surface command.

* * * * *